US006830035B2

(12) United States Patent
Nishiwaki et al.

(10) Patent No.: US 6,830,035 B2
(45) Date of Patent: Dec. 14, 2004

(54) STRUCTURE OF INSTALLING INJECTOR IN COMMON RAIL AND METHOD OF THE SAME

(75) Inventors: Toyoji Nishiwaki, Anjo (JP); Ryutaro Oomori, Aichi-gun (JP)

(73) Assignee: DENSO Corporation, Kariya (JP)

( * ) Notice: Subject to any disclaimer, the term of this patent is extended or adjusted under 35 U.S.C. 154(b) by 22 days.

(21) Appl. No.: 10/385,569

(22) Filed: Mar. 12, 2003

(65) Prior Publication Data

US 2003/0172911 A1 Sep. 18, 2003

(30) Foreign Application Priority Data

Mar. 15, 2002 (JP) ..... 2002-72669

(51) Int. Cl.[7] ..... F02M 51/00
(52) U.S. Cl. ..... 123/470
(58) Field of Search ..... 123/456, 468, 123/469, 470

(56) References Cited

U.S. PATENT DOCUMENTS 4,307,693 A 12/1981 Glockler et al.
5,136,999 A 8/1992 Bassler et al.
5,167,213 A * 12/1992 Bassler et al. ..... 123/470
5,301,647 A * 4/1994 Lorraine ..... 123/470
5,724,946 A * 3/1998 Franchitto ..... 123/470
6,019,089 A * 2/2000 Taylor et al. ..... 123/470
6,102,007 A * 8/2000 Furst ..... 123/469
6,374,809 B2 * 4/2002 Satou ..... 123/470
6,705,292 B2 * 3/2004 Bugos ..... 123/470
2004/0055578 A1 * 3/2004 Scollard et al. ..... 123/470

* cited by examiner

*Primary Examiner*—Thomas Moulis
(74) *Attorney, Agent, or Firm*—Nixon & Vanderhye PC.

(57) ABSTRACT

In a structure or method of installing an injector in a delivery pipe of a common rail, the injector on which a seal member and a clip member are mounted is inserted into an interior of the delivery pipe in such a manner that the clip member comes in contact with the delivery pipe after the seal member comes in contact with an interior wall of the delivery pipe. This structure or method has an advantage of preventing the foreign material, which is a part of the protection layer peeled off from the delivery pipe due to contact between the clip member and the delivery pipe, from being lodged between the seal member and the inner wall of the delivery pipe.

2 Claims, 3 Drawing Sheets

STRUCTURE OF INSTALLING INJECTOR IN COMMON RAIL AND METHOD OF THE SAME

CROSS REFERENCE TO RELATED APPLICATIONS

This application is based upon and claims the benefit of priority of Japanese Patent Application No. 2002-72669 filed on Mar. 15, 2002, the content of which is incorporated herein by reference.

BACKGROUND OF THE INVENTION

1. Field of the Invention

The present invention relates to a structure of installing an injector in a common rail to which fuel for internal combustion engine (hereinafter called "engine") is supplied and a method of the same.

2. Description of Related Art

As shown in FIG. 6, a structure of installing an injector 110 in a common rail 100 in use of a clip and a seal member 111 is well known. The common rail 100 is provided with a delivery pipe 101 extending radially outward. The injector 110 is fixed to the delivery pipe 101. The delivery pipe 101 and the clip 120 are provided on surfaces thereof with protection layers formed by plating or coating for securing erosion resistance and enhancing strength.

For fixing the injector 110 to the delivery pipe 101, the seal member 111 such as an O-ring and the clip 120 are mounted at first on an end portion of the injector 110. Then, the injector 110 is inserted into an interior of the delivery pipe 101. The delivery pipe 101 is provided at an end outer circumference thereof with a pair of projections 102 extending radially outward in opposite directions. The injector 110 is fixed to the delivery pipe 101 in such a manner that the projections 102 are snap engaged with openings 121 formed in the clip 120, while the seal member 111 seals a clearance between an interior wall 101*a* of the delivery pipe 101 and an outer circumference of the injector 110.

However, when the injector 110 on which the seal member 111 and the clip 120 have been mounted is inserted into the interior of the delivery pipe 101, the projections 102 come in contact with and slide on guide plates 122 for guiding the projections 102 to the openings 121 so that the protection layers formed on the delivery pipe 101 and the clip 120 tend to be peeled off.

If a part of the protection layers is peeled off due to contact between the projections 102 and the guide plates 122, the peeled protection layer falls down or scatters as foreign material 130. As a result, the foreign material 130 is sometimes lodged between the seal member 111 and the interior wall 101*a* of the delivery pipe 101, which causes the seal member 111 to seal insufficiently. Accordingly, the conventional structure of installing the injector 110 in the delivery pipe 101 has a drawback in that fuel is likely leaked from a joint portion between the injector 110 and the delivery pipe 101.

SUMMARY OF THE INVENTION

An object of the present invention is to provide a compact structure of installing an injector in a delivery valve with which foreign material is not lodged between a seal member and an interior wall of the delivery valve.

Another object of the present invention is to provide a simple method of installing an injector in a delivery valve with which foreign material is lodged between a seal member and an interior wall of the delivery valve.

To achieve the above object, in a structure of installing an injector in a common rail for an internal combustion engine, a delivery pipe of the common rail is provided on a surface thereof with a protection layer. A seal member is mounted on the attachment portion of the injector for sealing a clearance between an inner wall of the delivery pipe and an outer circumference of the attachment portion. A clip member has a bottom section mounted on the attachment portion on an opposite side of the seal member with respect to an axial end of the delivery pipe and a resilient sidewall section extending from outer periphery of the bottom section toward the delivery pipe and snap engaged with an outer circumference of the delivery pipe.

With the structure mentioned above, shape of the clip member is formed to satisfy a condition that, when the attachment portion on which the seal member and the clip member have been mounted is inserted into the inner wall of the delivery pipe in a state that the attachment portion is substantially axially aligned with the delivery pipe, the side wall section of the clip member comes in contact with the delivery pipe after the seal member comes in contact with the inner wall of the delivery pipe.

According to the structure mentioned above, foreign material, which is a part of the protection layer peeled off due to contact between the clip member and the delivery pipe, is not lodged between the seal member and the inner wall of the delivery pipe, since, when the clip member comes in contact with the delivery pipe, the seal member has already closely contacted the inner wall of the delivery pipe. Accordingly, the installation structure mentioned above has a superior sealing characteristic.

It is preferable that the delivery pipe is provided at an axial end outer circumference thereof with projections protruding outward and the side wall section of the clip member is provided with openings with which the projections are engaged.

With the projections and the openings, the injector is easily and confidently fixed to the delivery pipe.

A method of installing an injector in a delivery pipe of a common rail for an internal combustion engine with a resilient clip member and a seal member, where the delivery pipe is provided on a surface thereof with a protection layer and at an axial end outer circumference thereof with projections and the clip member is provided with openings, comprises the following steps.

First step is to mount the seal member and the clip member on an outer circumference of the injector so as to position the seal member on a side of an axial end of the injector with respect to the clip member. Second step is to insert the injector into the delivery pipe without causing the clip member to contact with the delivery pipe until the seal member comes in contact with an inner wall of the delivery pipe. Third step is to further insert the injector into the delivery pipe, while keeping a state that the seal member is in contact with the inner wall of the delivery pipe, so that the clip member comes in contact with the delivery pipe. Fourth step is to still further insert the injector into the delivery pipe until the projections are snap engaged with the openings.

The installation method mentioned above has an advantage of preventing the foreign material, which is a part of the protection layer peeled off due to contact between the clip member and the delivery pipe, from being lodged between the seal member and the inner wall of the delivery pipe.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Embodiments of the present invention are described with reference to figures.

Figure 1:
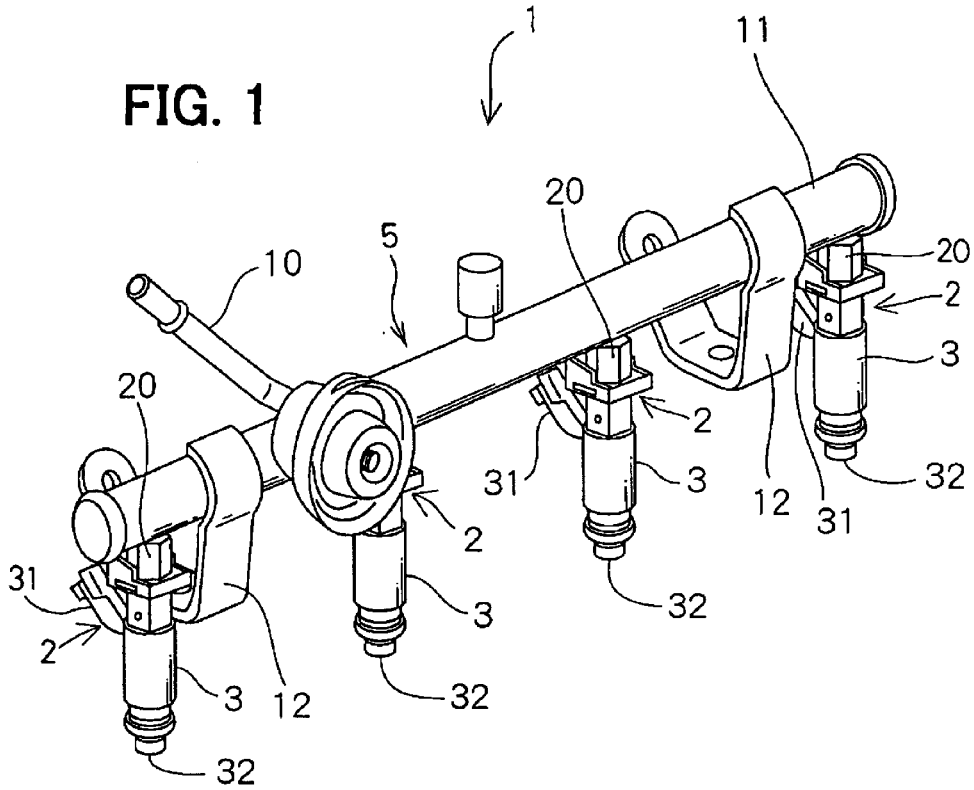
FIG. 1 is a perspective view of a fuel supply system provided with a structure of installing an injector in a common rail according to an embodiment of the present invention.

FIG. 1 shows a fuel supply system in which an injector is installed in a delivery pipe of a common rail according to an embodiment of the present invention. The fuel supply system 1 has a common rail 5 composed of a fuel supply pipe 10, a cylindrical fuel rail 11 and a plurality of delivery pipes 20 branched out from the fuel rail 11 and injectors 3 each installed in respective one of the delivery pipes 20 for supplying fuel to each cylinder of an engine (not shown). The fuel supply system 1 is mounted on an engine (not shown) through holding arms 12 each end of which is fixed to the fuel rail 11 and each another end of which is fixed to an engine head (not shown). The fuel supply pipe 10 is connected to a fuel pump (not shown). Fuel stored in a fuel tank (not shown) is pressurized by the fuel pump. The pressurized fuel is supplied to the fuel rail 11 through the fuel supply pipe 10 and accumulated in the fuel rail 11 under a given pressure.

Figure 3:
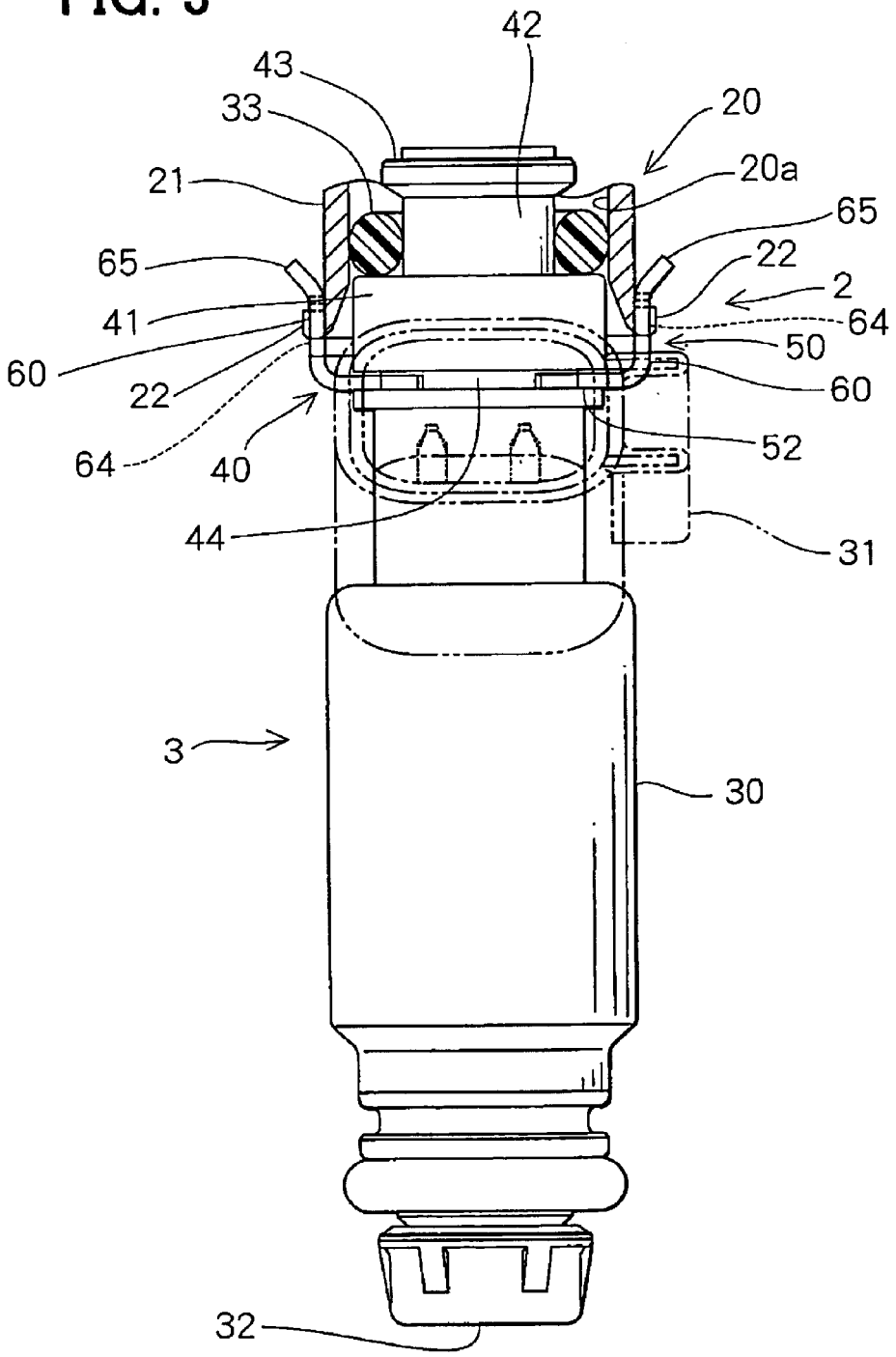
FIG. 3 is a schematic view of the injector installed in the common rail according to the embodiment of the present invention.

As shown in FIG. 3, the injector 3 is composed of an injector main body 30 and an attachment portion 40. The injector main body 30 has a connector 31, a valve needle (not shown) and an injection bore 32. The connector 31 is electrically connected with ECU (not shown). The valve needle is driven to open and close the injection bore 32 by drive current supplied to the connector 31 from ECU. When the injection bore 32 is opened, fuel supplied to the injector 3 through the delivery pipe 20 from the fuel rail 11 is injected to a combustion chamber of the engine.

The delivery pipe 20, which extends radially outward from the fuel rail 11, has a pipe portion 21 and two flange-like projections 22 formed at an end of the pipe portion 21 on an opposite side to the fuel rail 11. The projections 22 extend radially outward in opposite directions from an outer circumference of the pipe portion 21. The delivery pipe 20 is provided inside with a cylindrical fuel passage 23 through which fuel is supplied from the fuel rail 11 to the injector 3. A protection layer for securing erosion resistance and enhancing strength is formed on a surface of the delivery pipe 20. The protection layer is, for example, a metal plating layer or a resin coating layer.

Figure 2:
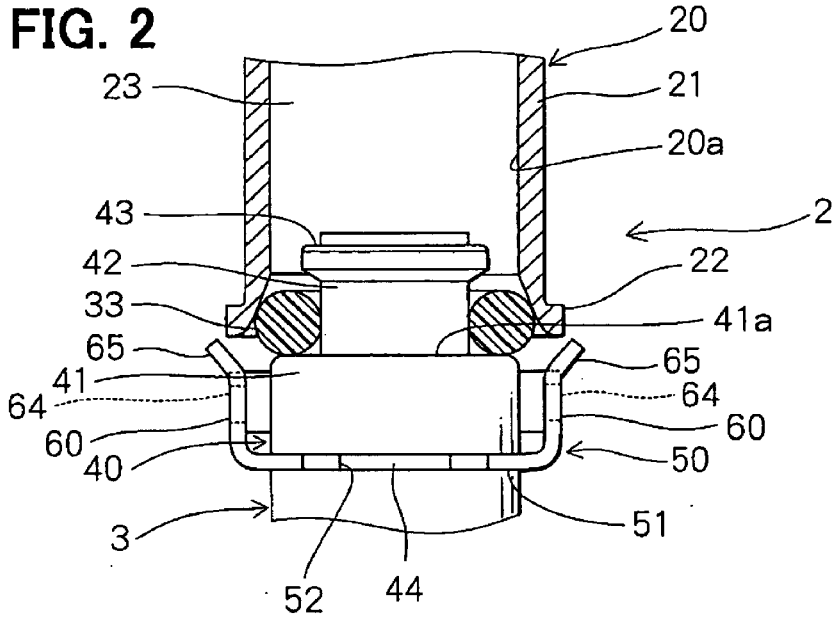
FIG. 2 is a schematic view of the structure of installing the injector in the common rail according to the embodiment of the present invention.

The attachment portion 40 is formed integrally with the injector main body 30. As shown in FIG. 2, the attachment portion 40 has a large diameter portion 41, a neck portion 42 and a flange portion 43. The attachment portion 40 is provided inside with a supply port (not shown) through which fuel is supplied from the delivery pipe 20 to the injector 3. An end of the large diameter portion 41 is connected to the neck portion 42 and the other end of the large diameter portion 41 is connected to the injector main body 30. An outer diameter of the large diameter portion 41 is larger than that of the neck portion 42. The large diameter portion 41 is provided on an outer circumference thereof with a groove 44 extending circumferentially. A clip member 50 is fitted to the groove 44. A seal member 33, which is an O-ring, is mounted on the neck portion 42. As shown in FIG. 3, the seal member 33 is in contact with an outer circumference of the neck portion 42, an inner wall 20*a* of the delivery pipe 20 (wall of the fuel passage 23) and a step surface 41*a* of the large diameter portion 41 on a side of the flange portion 43 so that the fuel to be supplied to the injector 3 never leaks to an outside of the injector 3 from the fuel passage 23.

Figure 4:
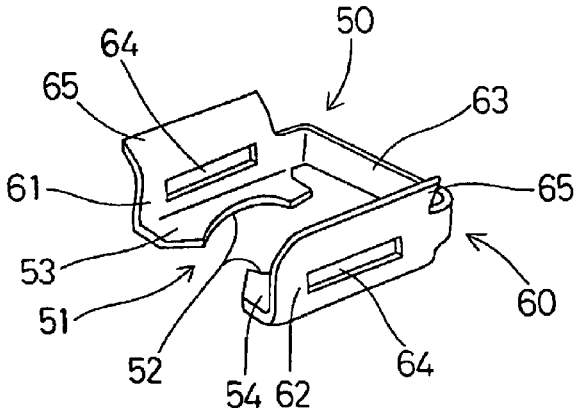
FIG. 4 is a perspective view of a clip member for fixing the injector to the common rail according to the embodiment of the present invention.

As shown in FIG. 4, the clip member 50 has a bottom section 51 and a side wall section 60 which are integrally formed. The clip member 50 may be provided on a surface thereof with a protection layer formed, for example, by metal plating or resin coating, which is similar as that of the delivery pipe 20. The bottom section 51 is composed of a pair of bottom plates 53 and 54 separated substantially in parallel on the same plane. The bottom plates 53 and 54 are provided on inner peripheries thereof opposed to each other with fitting portions 52 that are fitted to the groove 44. The side wall section 60 is composed of a pair of side wall plates 61 and 62 extending substantially perpendicularly to the bottom plates 53 and 54 from outer peripheries of the bottom plates 53 and 54, respectively, a pair of guide plates 65 extending obliquely outward and in a direction away from the bottom section 51 from peripheries of the side wall plates 61 and 62 on an opposite side to the bottom section 51, respectively, and a side wall plate 63 bridging respective ends of the side wall plates 61 and 62. The clip member 50, which is made of resilient material such as metal, is resiliently deformed, when the fitting portions 52 are fitted to the groove 44 and the clip member 50 is assembled to the attachment portion 40.

The side wall plates 61 and 62 are provided respectively with openings 64 whose each opening area is slightly larger than an area of each of the projections 22. The projections 22 are engaged with the openings 64, respectively. When the injector 3, to which the clip member 50 and the seal member 33 have been assembled, is moved toward the delivery pipe 20 for installing the injector 3 in the delivery pipe 20, inner surfaces of the guide plates 65 come in contact with the projections 22 and guide the delivery pipe 20 including the projections 22 into an interior of the clip member 50. Then, while the side wall plates 61 and 62 and the guide plates 65 are resiliently deformed to incline outward, the projections 22 slide on inner walls of the guide plate 65 and the side plates 61 and 62 until the projections 22 are snap engaged with the openings 64. In a state that the projections 22 are engaged with the openings 64, the inner walls of the side plates 61 and 62 are fitted to the outer circumference of the delivery pipe 20.

Shape of the side wall section 60 of the clip member 50 is formed to satisfy the following condition. When the attachment portion 40 of the injector 3, on which the seal member 33 and the clip member 50 have been mounted, is inserted into an interior of the delivery pipe 20 (into the fuel passage 23) in a state that the injector 3 is axially aligned with the delivery pipe 20, the side wall section 60 of the clip member 50 comes in contact with the delivery pipe 20 after the seal member 33 comes in contact with the delivery pipe 20.

According to the embodiment shown in FIG. 2, an axial length between the step surface 41*a* of the large diameter portion 41 and the bottom section 51 of the clip member 50 is longer than an axial length between a boundary of the guide plate 65 and the side wall plate 61 or 62 and the bottom section 51. After the seal member 33 contacting the step surface 41*a* comes in contact with the inner wall 20*a* of the delivery pipe 20, the guide plates 65 come in contact with the projections 22 of the delivery pipe 20. A positional relationship between the side wall section 60 and the seal member 33 is defined by shapes of the injector 3, the delivery pipe 20, the seal member 33 and the clip member 50.

A method of installing the injector 3 in the delivery pipe 20 is described below.

At first, the seal member 33 and the clip member 50 are mounted on the attachment portion 40 of the injector 3. The seal member 33 is attached to an outer circumference of the neck portion 42 and in contact with the step surface 41*a*. The clip member 50 is attached to the attachment portion 40 in such a manner that the fitting portion 52 is fitted to the groove 44. The injector 3, to which the seal member 33 and the clip member 50 have been assembled, is inserted into the interior of the delivery pipe 20 from a side of the projections 22 (from a lower side in FIG. 2) in a state that the injector 3 is axially aligned with the delivery pipe 20.

When the injector 3 is inserted into the delivery pipe 20, the seal member 33 comes in contact with the inner wall 20*a* of the delivery pipe 20 at first so that a clearance between the seal member 33 and the inner wall 20*a* of the delivery pipe 20 is blocked, which prevents foreign material from entering the fluid passage 23 through the clearance. Next, when the injector 3 is further inserted into the delivery pipe 20 in a state that the seal member 33 is in contact with the inner wall 20*a* of the delivery pipe 20, the guide plates 65 come in contact with the projections 22 for guiding the delivery pipe 20 into an interior of the clip member 50 and, then, the projections 22 slide on inner walls of the guide plates 65 and the side plates 61 and 62 until the projections 22 are snap engaged with the openings 64, as shown in FIG. 3. Accordingly, while the seal member 33 seals the clearance between the injector 3 and the inner wall 20*a* of the delivery pipe 20, the inner walls of the side wall plates 61 and 62 are fitted to the outer circumference of the delivery pipe 20 so that the injector 3 is installed in the delivery pipe 20.

When the guide plates 65 is in slidable contact with the projections 22, a part of the protection layer plated or coated on the surfaces of the delivery pipe 20 and the clip member 50 tends to be peeled off. The peeled protection layer falls down or scatters inside the clip member 50. However, the peeled protection layer is never lodged between the seal member 33 and the inner wall 20*a* of the delivery pipe 20 or never enters the fluid passage 23, since the seal member 33 has closely contacted the inner wall 20*a* of the delivery pipe 20 before the protection layer is peeled off.

As mentioned above, a structure for installing the injector 3 in the delivery pipe 20, which is shown with reference number 2, or the method of the same has advantages of preventing fuel leakage at a joint portion between the injector 3 and the delivery pipe 20 and invasion of foreign material into the fuel passage 23.

Further, according to the embodiment mentioned above, the injector 3 is installed in the delivery pipe 20 by just inserting the injector 3 into the delivery pipe 20 after the seal member 33 and the clip member 50 are mounted on the injector 3 so that the installation method is simpler. Furthermore, the injector 3 is installed in the delivery pipe 20 by just resiliently fixing the clip member 50 to the delivery pipe 20 and engaging the projections 22 with the openings 64 so that the structure 2 is more compact.

Moreover, the embodiment mentioned above can be achieved by just modifying shape of the side wall section 60 of the clip member 50 from that of a conventional clip member in consideration of shapes of the injector 3, the delivery pipe 20 and the seal member 33 in such a manner that the seal member 33 comes in contact with the delivery pipe 20 before the clip member 50 comes in contact with the delivery pipe 20.

Modification

A modification of the installation structure according to the embodiment mentioned above is described with reference to FIG. 5.

Figure 5:
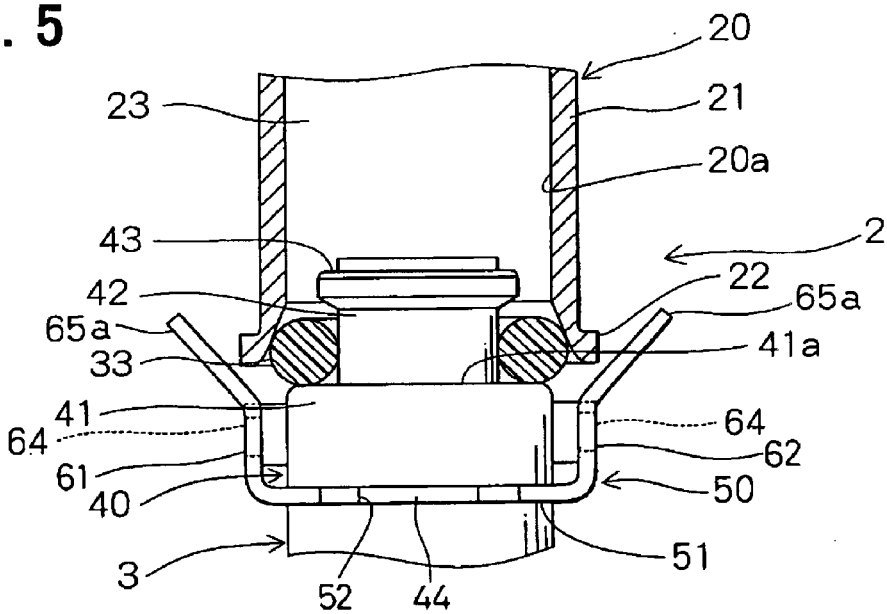
FIG. 5 is a schematic view of a structure of installing an injector in a common rail according to a modification of the embodiment of the present invention.
Figure 6:
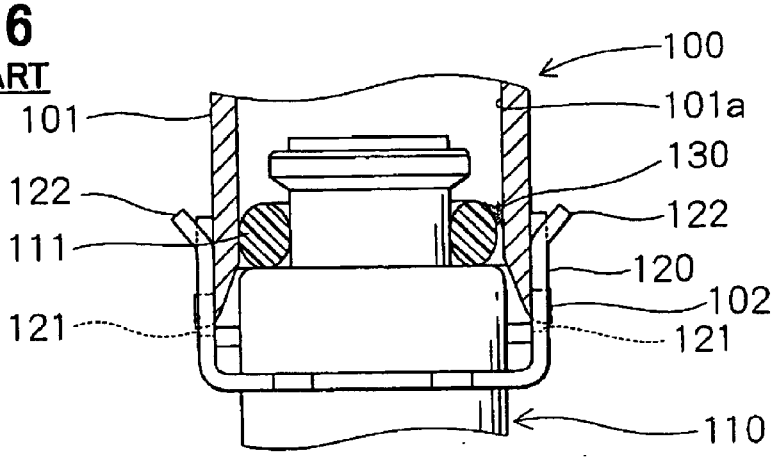
FIG. 6 PRIOR ART
FIG. 6 is a schematic view of a conventional structure of installing an injector in a common rail as a prior art.

As shown in FIG. 5, each length of guide plates 65*a* according to the modification is longer than that according to the embodiment mentioned above. However, the guide plates 65*a* never come in contact with the delivery pipe 20 before the seal member 33 comes in contact with the inner wall 20*a* of the delivery pipe 20, even if the length of the guide member 65*a* is longer. Accordingly, the foreign material of the peeled protection layer is never lodged between the seal member 33 and the inner wall 20*a* of the delivery pipe 20.

Further, According to the embodiment of the present invention or the modification thereof, though it is preferable that the axial length between the step surface 41*a* of the large diameter portion 41 and the bottom section 51 of the clip member 50 is longer than the axial length between a boundary of the guide plate 65 or 65*a* and the side wall plate 61 or 62 and the bottom section 51, the axial length between the step surface 41*a* and the bottom section 51 may be equal to or shorter than the axial length between the boundary of the guide plate 65 or 65*a* and the side wall plate 61 or 62 and the bottom section 51, as far as the guide plates 65 or 65*a* come in contact with the delivery pipe 20 after the seal member 33 comes in contact with the inner wall 20*a* of the delivery pipe 20. That is, shape of the clip member 50, in particular, length of the guide plate 65 or 65*a*, length of the side wall plate 61 or 62, angle of the guide plate 65 or 65*a* to the side wall plate 61 or 62 and so on, can be defined in consideration of protruding length or position of the projection 22, shape of the seal member 33, shape of the inner wall 20*a* of the delivery pipe 20 and the like so that the guide plates 65 or 65*a* come in contact with the delivery pipe 20 after the seal member 33 comes in contact with the inner wall 20*a* of the delivery pipe 20.

What is claimed is:

1. A method of installing an injector in a delivery pipe of a common rail for an internal combustion engine with a resilient clip member and a seal member, wherein the delivery pipe is provided on a surface thereof with a protection layer and at an axial end outer circumference thereof with projections and the clip member is provided with openings, comprising steps of:

mounting the seal member and the clip member on an outer circumference of the injector so as to position the seal member on a side of an axial end of the injector with respect to the clip member;

inserting the injector into the delivery pipe without causing the clip member to contact with the delivery pipe until the seal member comes in contact with an inner wall of the delivery pipe;

further inserting the injector into the delivery pipe, while keeping a state that the seal member is in contact with the inner wall of the delivery pipe, so that the clip member comes in contact with the delivery pipe; and still further inserting the injector into the delivery pipe until the projections are snap engaged with the openings.

2. A method for installing a fuel injection in a common rail delivery pipe for an internal combustion engine using a resilient clip member and a seal member, wherein the delivery pipe is provided with a surface protection layer and projections at an axial end outer circumference mating with openings on the clip member, said method comprising:

mounting the seal member and the clip member on an outer axial end circumference of the injector with a seal surface projecting axially beyond all clip member surfaces;

inserting the injector into the delivery pipe so that the seal member comes in contact with an inner wall of the delivery pipe before the clip member contacts the delivery pipe;

further inserting the injector into the delivery pipe while keeping the seal member in contact with an inner wall of the delivery pipe so that the clip member next comes in contact with the delivery pipe; and still further inserting the injector into the delivery pipe until the projections of the delivery pipe are snap engaged with the openings of the clip member.

* * * * *